US006465413B1

(12) United States Patent
Hinton

(10) Patent No.: US 6,465,413 B1
(45) Date of Patent: Oct. 15, 2002

(54) DETERGENT

(76) Inventor: Gerald Thomas Hinton, Eastfield Stonebyres, Lanark ML11 9UW (GB)

( * ) Notice: Subject to any disclaimer, the term of this patent is extended or adjusted under 35 U.S.C. 154(b) by 0 days.

(21) Appl. No.: 09/341,405

(22) PCT Filed: Jan. 12, 1998

(86) PCT No.: PCT/GB98/00089

§ 371 (c)(1),
(2), (4) Date: Jul. 9, 1999

(87) PCT Pub. No.: WO98/30670

PCT Pub. Date: Jul. 16, 1998

(30) Foreign Application Priority Data

Jan. 10, 1997 (GB) ..... 9700415
Sep. 24, 1997 (GB) ..... 9720190
Oct. 25, 1997 (GB) ..... 9722527

(51) Int. Cl.[7] ..... C11D 3/39; C11D 17/00

(52) U.S. Cl. ..... 510/439; 510/233; 510/302; 510/309; 510/347; 510/349; 510/375; 510/441; 510/446; 510/466; 510/486; 510/509; 510/511; 510/512; 510/534

(58) Field of Search ..... 510/233, 302, 510/309, 347, 349, 375, 441, 446, 466, 486, 509, 511, 512, 534, 439

(56) References Cited

U.S. PATENT DOCUMENTS 3,413,229 A * 11/1968 Bianco et al. ..... 252/90

FOREIGN PATENT DOCUMENTS

| | | | |
|---|---|---|---|
| EP | 0 481 793 | A1 | 4/1992 |
| EP | 0 639 639 | A1 | 2/1995 |
| FR | 2 666 348 | A1 | 3/1992 |
| FR | 2666348 | A1 * | 6/1992 |
| WO | 92/01037 | | 1/1992 |
| WO | 95/28467 | | 10/1995 |

* cited by examiner

*Primary Examiner*—Mark Kopec
*Assistant Examiner*—Brian P. Mruk
(74) *Attorney, Agent, or Firm*—Drinker Biddle & Reath LLP

(57) ABSTRACT

This invention discloses laundering and dishwashing products which can be incorporated in a single compartment water soluble film sachet, the formulation comprising a granulated percarbonate compound mixed with and encapsulated in an encapsulating blend comprising sulfate, carboxy methyl cellulose and nonionic surfactant, wherein the detergent composition does not include zeolites or perborates.

9 Claims, 2 Drawing Sheets

DETERGENT

This invention relates to a detergent product formulations which can be packaged in water soluble film.

A product of the invention is ideally for use in the laundering and conditioning of industrial and domestic manmade and/or natural fabrics in semiautomatic or automatic washing machines. It may also be used in dishwashers. For convenience purposes it is useful if this can be achieved by means of a soluble single compartment sachet containing varying amounts of bleaching detergents including for example sodium percarbonate. Typically a sachet may be made from a water soluble film such as PVA.

Conventional laundering detergents comprise perborates and zeolites and these compounds are not stable in water soluble film. Previous attempts have been made to manufacture fully built detergent and conditioner systems in a sachet have required a twin compartment sachet manufactured from a perforated film. These fully built detergent and conditioner systems generally contain bleaching agents. Sodium percarbonate is recognised in this field as a bleaching agent. However, use of percarbonate in sachets is not popular as it is unstable when combined with other components of a high moisture content.

Twin compartment sachets have a disadvantage in that they require greater mechanical action to dissolve the sachet and thus have long dispersion times. Also, they are expensive to manufacture.

Additionally, the perforated film used in these twin compartment sachets does not confer a significant shelf life to the components contained within the sachet, wherein the oxidising power of the bleaching agent is reduced.

Also, typically these formulations contain zeolites. These have high moisture content which affects the mechanical properties of the film e.g. the pliability.

It is an object of the present invention to provide a detergent or bleaching agent for cleaning in laundries, or in domestic washing machines or dishwashers which is stable within a water soluble film.

According to the present invention there is provided a granulated percarbonate compound suitable for use in cleaning products wherein the percarbonate compound has been mixed with an encapsulating blend.

Preferably the encapsulating blend comprises sulphate, carboxy methyl cellulose and nonionic surfactant.

The invention further provides an encapsulation blend comprising sodium sulphate, carboxymethyl cellulose and a nonionic surfactant blend.

Suitably the surfactant is an alkyl ($C_6$ to $C_{12}$) aryl polyglycol ethoxylate (phenol ethoxylate).

Suitably the percarbonate granules have a size of not less than 150 microns.

The invention further provides a detergent formulation comprising sodium percarbonate, carboxy methyl cellulose, sodium sulphate, nonionic surfactant blend, sodium silicate and sodium tripolyphosphate and not including zeolites or perborates.

The detergent may further comprise at least one ingredient chosen from the group comprising linear alkylbenzene sulphonate, sodium carbonate, low foam wetting agent, perfumes, cationic surfactant, optical brighteners, salts, pigments and enzymes.

In one embodiment the detergent formulation is a laundering product.

In an alternative embodiment the detergent is a machine dishwashing product.

Suitably the laundry or dishwashing product according to the present invention is packaged in PVA film. A product of the invention is stable in PVA film compared to other products containing zeolites and perborates.

Suitably the film is 20–80 microns thick.

The product may be incorporated into a tablet form.

The granulated form of percarbonate in the above permits efficient bleaching action of the laundry product whilst not effecting the stability of the product in storage.

While modifications and improvements may be made without departing from the scope of this invention, the following is a description of the invention, with reference to the accompanying diagram:

The sachets are sealed such that they contain a laundry and conditioning powder without spillage or air borne contamination which can cause irritation to eyes and/or skin etc.

EXAMPLE 1

The laundry and conditioning powder can be in the form of a super concentrate with a bulk density of not less than 0.75 kg/1. The laundry and conditioning powder is preweighed and packed in 50 g batches which is sufficient to launder 4.5 kg dry weight of mixed fibres (normal soiling) in either hard or soft water conditions.

In order to determine the storage and durability of sachets containing laundry and conditioner, the sachets were treated as follows:

1. Laundry and conditioner products including the granulated percarbonate compound were sealed in PVA sachets under atmospheric conditions and stored in various temperatures.

2. Sachets containing the laundry and conditioner products were sealed in a PVC container under atmospheric conditions as stored at various temperatures.

The samples of both 1 and 2 above were stored for nine months whereupon they were added to separate washing cycles. In both cases the samples were found to be stable (both before use and after storage) with no deterioration of the product or the sachet containing the product.

Sachets were dissolved in cold water (20° C.) using a combination of water flow and mechanical agitation whereupon sachets and contents were typically completely dissolved with no residue within 90 seconds.

The polyvinyl alcohol film was 30–85 microns (+/−10–15%) thick. The polyvinyl alcohol film is both biodegradable and nonhazardous.

Figure 1A:
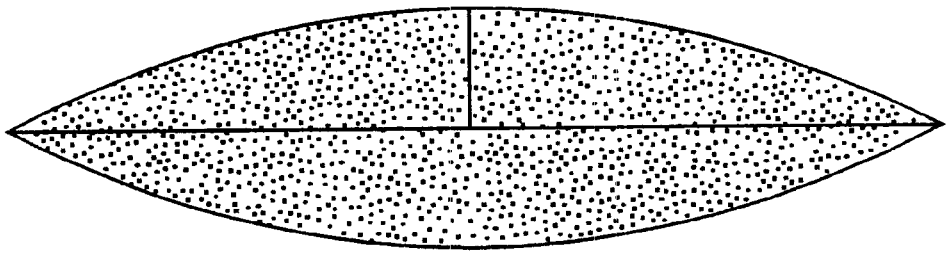
FIGS. 1*a* and 1*b* illustrate a soluble single compartment sachet produced from a polyvinyl alcohol (PVA) film filled with product and heat sealed.

The process for producing the sachets according to FIGS. 1*a* and *b* containing the dishwashing, laundry and/or conditioner product requires a form filling machine modified such that the sachet is produced with a minimum number of folds and seals.

Figure 2A:
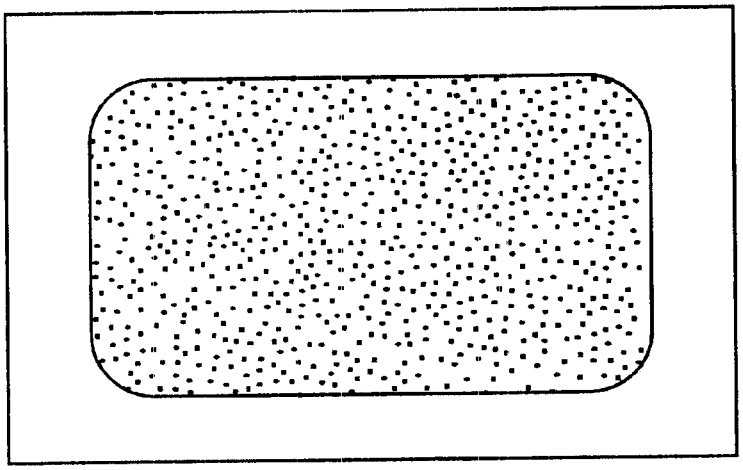
FIGS. 2*a* and 2*b* illustrate a soluble single compartment sachet produced from PVA film by thermoforming.
Figure 2B:
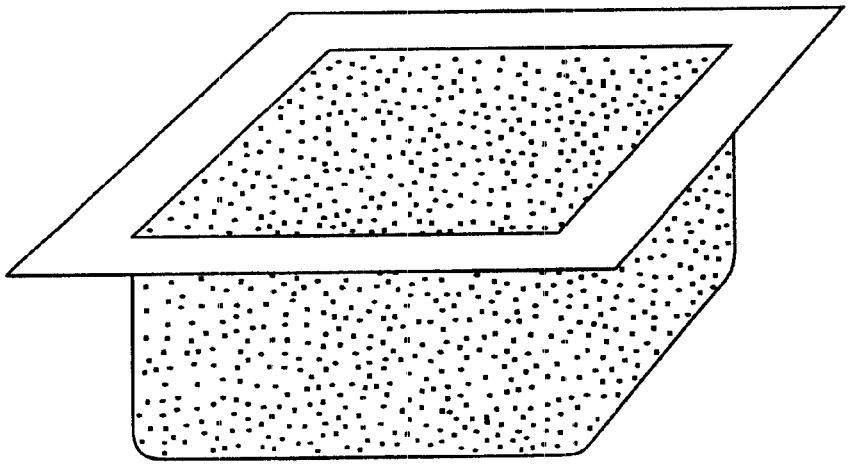

Alternatively thermoforming of film can be used to produce filed sachets as illustrated in FIG. 2.

EXAMPLE 2

Typical Detergent Product Formulations

| | |
|---|---|
| Linear alkylbenzene sulphanate | 0–5% |
| Sodium Percarbonate | 1–15% |
| Carboxy Methyl Cellulose | 1–5% |
| Sodium Sulphate Anhydrous | 5–35% |
| Sodium Carbonate | 0–35% |
| Nonionic Surfactant Blend | 1–10% |
| Low Foam Wetting Agent | 0–2% |
| Sodium Metasilicate | 1–30% |
| Sodium Tripolyphosphate | 1–30% |
| Perfumes | 0–1.5% |
| Cationic Surfactant | 0–5% |
| Optical Brighteners | 0–1% |
| Salts | 0.10% |
| Enzymes (blended) | 0–5% |
| Copolymer | 0–10% |
| Water Soluble Dye Pigment | 0–2% |

Minor ingredients as required.

Varying amounts of the above components may be used depending on the type of product required, i.e. for laundering, dishwashing or conditioning.

In the following examples nonoinic surfactant blend and low foam wetting agent are together referred to as liquid blend.

EXAMPLE 3

Laundry Product (1)

A laundering product was prepared and packaged in PVA film.

The formulation consisted of

| | |
|---|---|
| Linear alkylbenzene sulphate | 1% |
| Sodium Percarbonate | 5.1% |
| Carboxy Methyl Cellulose | 1% |
| Sodium Sulphate Anhydrous | 20% |
| Sodium Carbonate | 28% |
| Liquid blend | 2% |
| Sodium Metasilicate | 20% |
| Sodium Tripolyphosphate | 20% |
| Perfumes | 0.8% |
| Cationic Surfactant | — |
| Optical Brighteners | 0.5% |
| Salts | 2% |
| Enzymes (blended) | 1% |

EXAMPLE 4

Laundry Product (2)

A laundering product was prepared and packaged in PVA film.

The formulation consisted of

| | |
|---|---|
| Linear alkylbenzene sulphate | 1.5% |
| Sodium Percarbonate | 7.0% |
| Carboxy Methyl Cellulose | 1.0% |
| Sodium Sulphate Anhydrous | 18.0% |
| Sodium Carbonate | 28.0% |
| Liquid blend | 2.0% |
| Sodium Metasilicate | 20.0% |
| Sodium Tripolyphosphate | 15.0% |
| Perfumes | 0.8% |
| Cationic Surfactant | — |
| Optical Brighteners | 0.5% |
| Salts | 5.0% |
| Enzymes (blended) | 1.0% |
| Copolymer | 1.0% |

Inclusion of copolymer improved redeposition.

EXAMPLE 5

Machine Dishwashing Powder

A dishwashing powder was prepared and packaged in PVA film.

The formulation consisted of

| | |
|---|---|
| Linear alkylbenzene sulphate | — |
| Sodium Percarbonate | 5.6% |
| Carboxy Methyl Cellulose | 1% |
| Sodium Sulphate Anhydrous | 20% |
| Sodium Carbonate | Balance |
| Liquid blend | 2–3% |
| Sodium Metasilicate | 40% |
| Sodium Tripolyphosphate | 20% |
| Perfumes | — |
| Cationic Surfactant | — |
| Optical Brighteners | — |
| Salts | 5% |
| Enzymes (blended) | 0.8% |

Production of Formulation

Figure 1B:
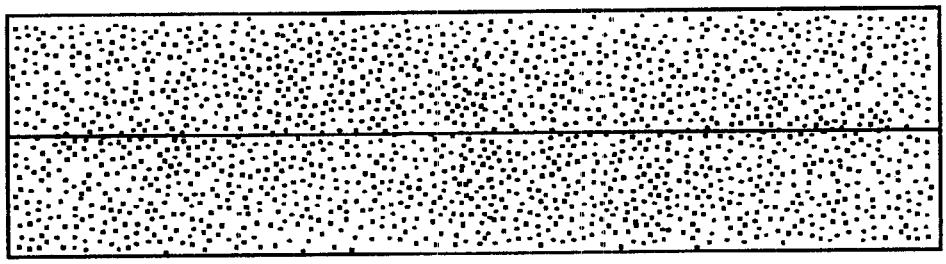

The percarbonate was added to the sachet as shown in FIG. 1 in the form of granules. These granules comprised percarbonate, sulphate and carboxy methyl cellulose in varying amounts together with a blend of nonionic surfactants to create a binding agent. These components were processed in order to produce a dust free granule of a diameter not less than 150 microns.

In order to produce the granules a horizontal type mixer was used. A liquid blend of the abovementioned laundry components was added to the mixer from a high pressure vessel incorporating an agitator. The liquid blend was fed in at a pressure of 60 pounds per squares inch.

The finished granulated detergent is fully biodegradable and has a stable pH range of 10–11, which does not affect the PVA film stability as used in this invention.

Trials have shown that using nonionic surfactants comprising alkyl aryl polyglycol ethoxylates through the alkyl group $C_{6-12}$ (typically $C_{8-10}$) is stable and gives the best results even after storage in excess of 9 months.

A typical encapsulation blend is as follows:

| | |
|---|---|
| Sodium Sulphate (Anhydrous) | 5–98% |
| Carboxy Methyl Cellulose | 1–25% |
| Nonionic Surfactant blends | 1–40% |

Alternative nonionic surfactant blends comprising alcohol polyglycol ethoxylate oxide in the range of 0.5–5% have been used successfully.

The advantages of the invention and of the ways in which the disadvantages of the previously known arrangements are overcome include encapsulation of a percarbonate with a powder/liquid blend forming a granular product of suitable size and strength for use in a hot or cold process.

A single component sachet sealed such that the percarbonate does not decompose in the detergent contained within the sachet.

Upon dissolution the PVA leaves no residues i.e. it is fully dissolved.

No mechanical action is required to dissolve the PVA film.

The encapsulation process extends the shelf life of fully built detergent within the PVA sachet.

In the super concentrated form, a laundering formulation normally requires 50 g per 4.5 kg (dry weight) wash with normal soiling.

What is claimed is:

1. A detergent composition comprising a granulated percarbonate and a blend which encapsulates the percarbonate, the blend comprising a sulphate, carboxymethyl cellulose and a nonionic surfactant, wherein the detergent composition comprises sodium metasilicate and sodium tripolyphosphate and does not include a zeclite or a perborate, and wherein the composition is capable of being stored in a water-soluble PVA film packaging for at least nine months and wherein the composition comprises between 1% and 15% percarbonate.

2. A composition as claimed in claim 1 wherein the percarbonate is sodium percarbonate.

3. A composition as claimed in claim 1 or claim 2 wherein the sulphate is sodium sulphate.

4. A composition as claimed in any of claims 1 or 2 wherein the surfactant is alkyl ($C_6$ to $C_2$) aryl polyglycol ethoxylate.

5. A composition as claimed in any of claims 1 or 2 wherein the composition further comprises at least one of the ingredients chosen from the group comprising linear alkylbezene suphonate, sodium carbonate, low foam wetting agent, perfumes, cationic surfactant, optical brighteners, salts and enzymes.

6. A composition as claimed in any of claims 1 or 2, wherein the composition is a laundering product.

7. A composition as claimed in any of claims 1 or 2 wherein the composition is a machine dishwashing product.

8. A composition as claimed in any one of claims 1 or 2 wherein the PVA film is 20–80 microns thick.

9. A composition as claimed in any one of claims 1 or 2 wherein the product is compressed into a tablet format.

* * * * *

UNITED STATES PATENT AND TRADEMARK OFFICE

CERTIFICATE OF CORRECTION

PATENT NO. : 6,465,413 B1
APPLICATION NO. : 09/341405
DATED : October 15, 2002
INVENTOR(S) : Gerald Thomas Hinton It is certified that error appears in the above-identified patent and that said Letters Patent is hereby corrected as shown below:

1. In claim 1:
- In column 5, at line 7, change “zeclite” to --zeolite--

2. In claim 4:
- In column 5, at line 17, change “(C6 to C2)” to --(C6 to C12)--

3. In claim 5:
- In column 6 at line 4, change “alkylbezene” to --alkylbenzene--
- In column 6 at line 4, change “suphonate” to --sulphonate--

Signed and Sealed this

Twenty-fifth Day of March, 2008

JON W. DUDAS
*Director of the United States Patent and Trademark Office*

UNITED STATES PATENT AND TRADEMARK OFFICE

CERTIFICATE OF CORRECTION

PATENT NO. : 6,465,413 B1
APPLICATION NO. : 09/341405
DATED : October 15, 2002
INVENTOR(S) : Gerald Thomas Hinton It is certified that error appears in the above-identified patent and that said Letters Patent is hereby corrected as shown below:

In claim 9:
- In column 6, at line 14, change “any one of claims 1 or 2” to “claim 6”.

Signed and Sealed this

Third Day of March, 2009

JOHN DOLL
*Acting Director of the United States Patent and Trademark Office*